United States Patent [19]

Kittle

[11] 4,025,138

[45] May 24, 1977

[54] PROGRESSIVE SLIDE ASSEMBLIES

[75] Inventor: Keith B. Kittle, Berwyn, Pa.

[73] Assignee: Halle Industries Inc., New York, N.Y.

[22] Filed: Feb. 20, 1975

[21] Appl. No.: 551,363

[52] U.S. Cl. ..... 312/334

[51] Int. Cl.[2] ..... A47B 88/00

[58] Field of Search ..... 308/3.8, 3.9, 3 R, 6 R, 308/3.6; 312/334–338, 341–348, 332, 340

[56] References Cited

UNITED STATES PATENTS

| | | | |
|---|---|---|---|
| 1,049,263 | 12/1912 | Pigg | 308/6 R |
| 1,079,927 | 11/1913 | Bradner | 308/3.8 |
| 1,223,112 | 4/1917 | Rixson | 308/6 R |
| 2,483,653 | 10/1949 | Lustig | 308/3.8 |
| 3,078,129 | 2/1963 | Beeck | 308/3.8 |
| 3,203,749 | 8/1965 | Bullock et al. | 308/3.8 |
| 3,275,396 | 9/1966 | Hillson et al. | 312/341 R |
| 3,488,097 | 1/1970 | Fall | 308/3.8 |
| 3,521,939 | 7/1970 | Fall et al. | 308/3.6 X |
| 3,545,833 | 12/1970 | Stein et al. | 312/341 |
| 3,687,505 | 8/1972 | Fall et al. | 308/3.8 |
| 3,722,964 | 3/1973 | Chitester et al. | 308/3.8 |
| 3,778,120 | 12/1973 | Hagen et al. | 312/340 X |
| 3,901,565 | 8/1975 | Hagen et al. | 312/332 X |
| 3,911,835 | 10/1975 | Schill | 308/3.6 X |

*Primary Examiner*—Paul R. Gilliam
*Assistant Examiner*—V. N. Sakran
*Attorney, Agent, or Firm*—Frederick J. Olsson

[57] ABSTRACT

Slide assembly including a drawer slide and a frame slide with interconnecting gusset means. In one embodiment there is a single gusset. In another body there are multiple gussets. Gusset mounts continuous loop cable for driving slides upon opening and closing of the drawer. Cable material and pin-eye type couplers make for easy assembly and automatic tautness.

9 Claims, 8 Drawing Figures

PROGRESSIVE SLIDE ASSEMBLIES

This invention relates to improvements in progressive slide assemblies.

In one aspect the invention provides for an improved progressive slide assembly having gussets at its opposite ends for connecting the drawer and frame slides, the dual arrangement and gusset design providing the following substantial advantages:

a. In lieu of offering progressive slide assemblies in a limited number of standard lengths, the user now has a choice of an infinite number of lengths and without a tool cost penalty.
b. The gusset has a singular design adapting the same for use on the front or back of the slide assembly and for both right and left hand applications.
c. The design of the gusset adapts the same for manufacture by high speed progressive dies.
d. Material is eliminated without sacrifice of necessary rigidity.

In another aspect the invention provides for an improved cable drive for progressive slide assemblies. The cable is both flexible and slightly yieldable axially and eye-type connectors are fastened to the ends. When the cable is mounted it can be stretched and then slipped over anchoring pins so that it is in a taut condition. Among the important advantages are: (a) minimum time in assembly; (b) elimination of mechanical tautness adjusting means such as sliders, brackets, etc., and; (c) very low cost.

Other advantages of the invention will be better apparent from the following description taken in conjunction with the drawings wherein.

Figure 1:
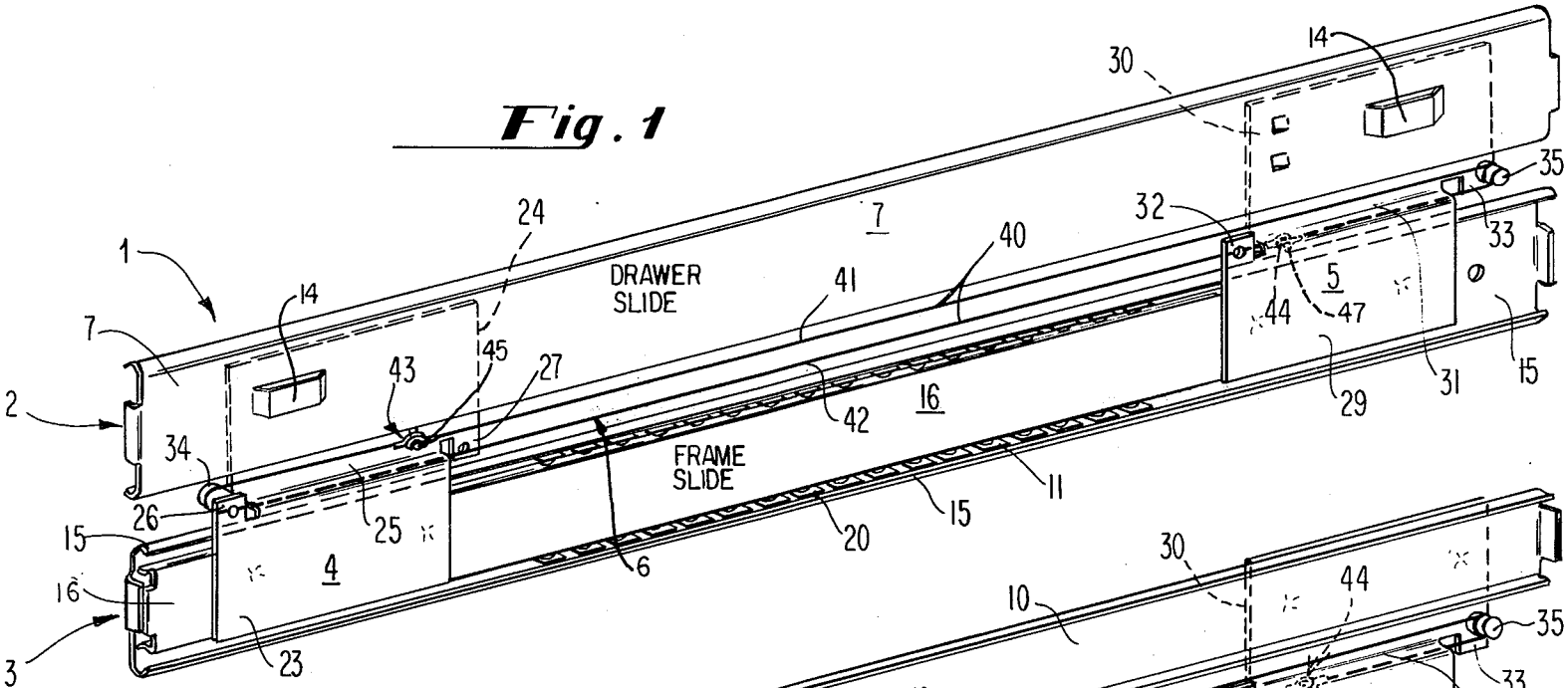
FIG. 1 is a perspective view of a multi-gusset slide assembly constructed in accordance with the invention.

In FIG. 1 the slide assembly is indicated at 1 and includes the elongated drawer slide 2 and elongated frame slide 3 which are joined together by the gussets 4 and 5. A cable drive is indicated at 6. As noted, the drawer and frame slides are mounted one above the other and extend generally parallel one another and are substantially coextensive.

As it will be understood by those skilled in the art, term "drawer slide" and term "frame slide" are used for ease of description. The term "drawer slide" as used in the specification and in the claims is intended to apply not only to a drawer such as, for example, a drawer to a file cabinet, but to any moveable member that is to be supported for a translatory back and forth motion. Like wise, the term "frame member" is intended to apply not only to a frame such as the frame of a file cabinet but to any member that is fixed and supports a drawer or other like moveable member.

The slides 2 and 3 per se are of conventional construction. The drawer slide 2 includes the outer race 7, the inner race 10, the ball retainers 11 and ball bearings 12. The race is arranged to be connected to drawer 13 as by the keepers 14.

The frame slide 3 includes the outer race 15 and the inner race 16, ball retainer 20 and ball bearings 21. The outer race is connected to the frame 22 as by screws or a nut and bolt arrangement not shown.

In supporting a drawer or other moveable member a slide assembly is used to support the left side of the drawer and an assembly is used to support the right side.

The structure and function of the gussets and cable drive will be explained in detail below.

The gussets 4 and 5 are identical in structure. Referring to gusset 4 the same is comprised of the lower section 23 spot welded to the inner race 16 and upper section 24 spot welded to the inner race 10. A bridge 25 connects the upper and lower sections. The bridge 25 is disposed in the space between the drawer slide 2 and frame slide 3. The lower and upper sections 23 and 24 have ears 26 and 27 located at opposite ends of the bridge 25.

The other gusset 5 has lower section 29 spotted to the race 16 and upper section 30 spotted to the race 10. The bridge 31 connects the two sections. The lower and upper sections have the ears 32 and 33.

In gusset 4, the ear 26 supports the sheave 34 while in gusset 5 the ear 33 supports the sheave 35. Each sheave is a small, cylindrically shaped Nylon button having a peripheral groove. As noted in FIG. 4, the sheave 34 is rotatably mounted on the pin 36 between the head 37 and the ear 26. The pin 36 is maintained in position by a shoulder on the pin (not shown) bearing on ear 26 and held firm against the ear by the upset head 37. The sheave 35 is similarly mounted on the ear 35. Sheaves can be mounted on the ears 27 and 32 in like manner.

The function of the gussets 4 and 5 is to hold the slides 2 and 3 together and maintain the same in desired alignment. Also, the gussets participate in the relative slide movement of the kind mentioned hereinafter.

As will be apparent from the drawings, the design of the gussets provides for the same to be used at either end of the slide assembly whether the slide is on the left hand side or the right hand side of the cabinet. This greatly reduces inventory requirements.

The shape of the gusset especially adapts the same to be manufactured by high speed progressive dies. This method of manufacture coupled with the versatility of a single design being useful at the front back or left of right hand sides substantially reduces tooling costs.

The dual gusset concept provides for infinite choice of slide assembly lengths. The inner and outer races of the slides are made on a roll former so difference in length is merely a matter of setting the cutoff point.

Thus, slide assembly length is merely a matter of selecting the length of the race as the gussets are spot welded adjacent the ends irrespective of the length.

It is contemplated, of course, that for very long slide assemblies which must carry extraordinary loads, one or more additional gussets may be used at a point intermediate the two outboard gussets.

Figure 2:
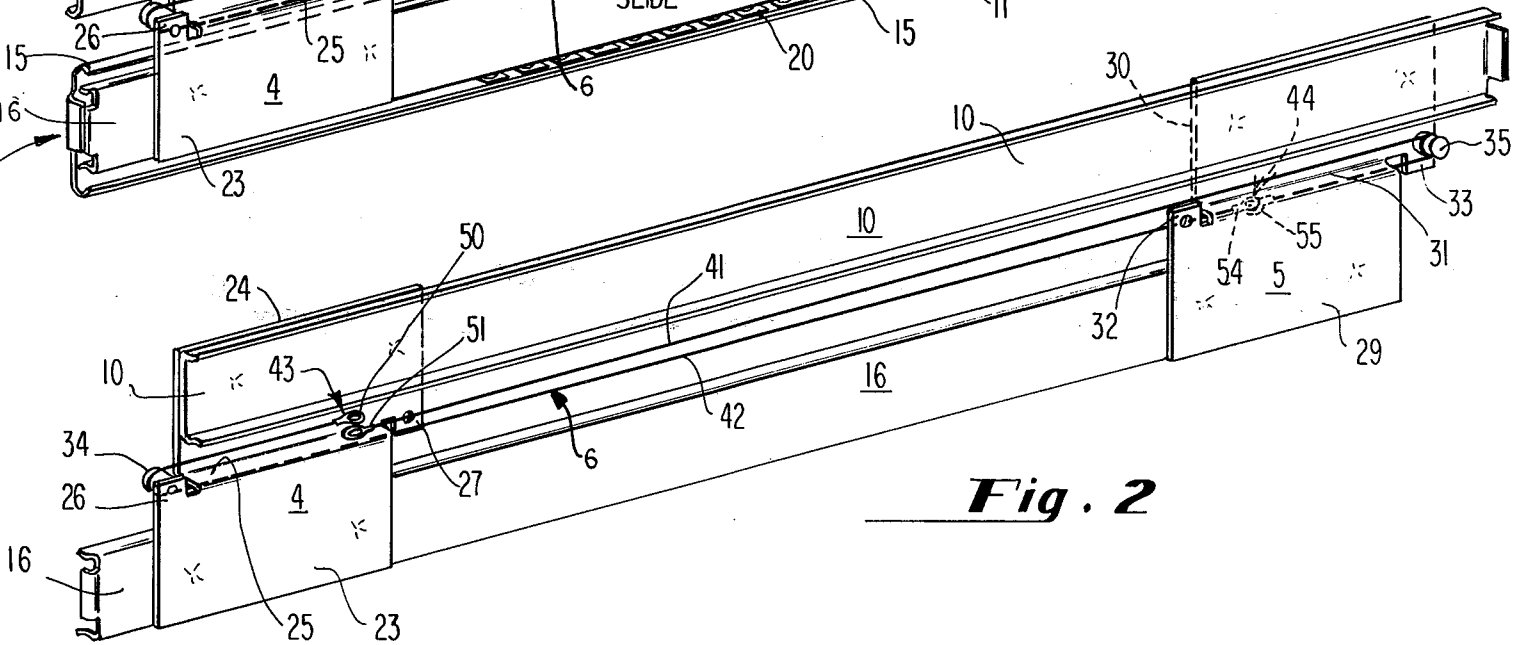
FIG. 2 is a perspective view of the arrangement of FIG. 1 with the outer races of the drawer and frame slides removed.
Figure 3:
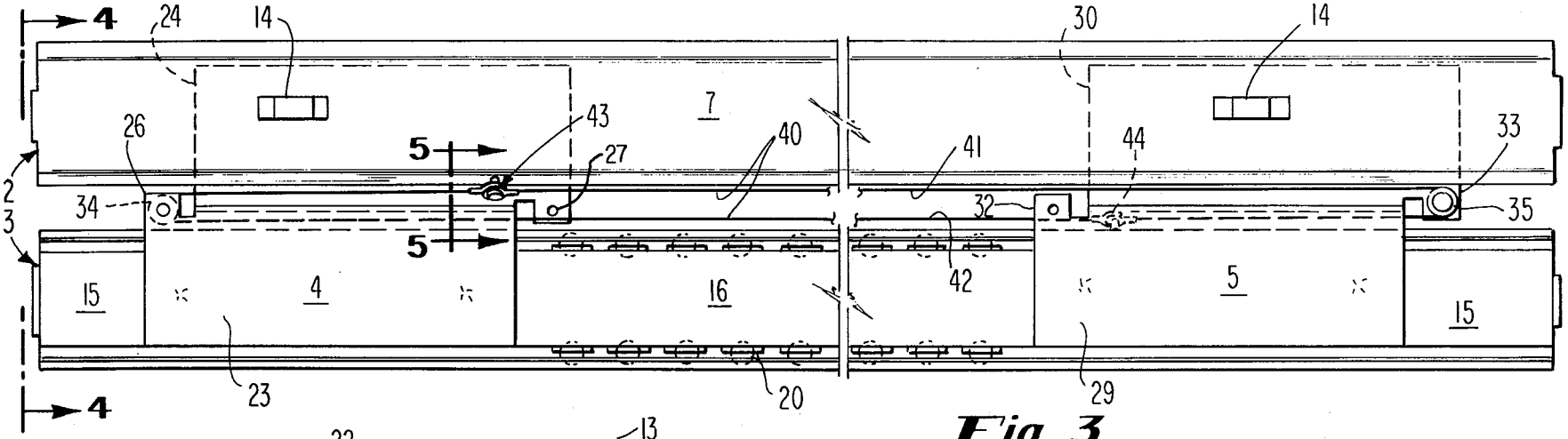
FIG. 3 is an elevational view of the slide assembly of FIG. 1.

As shown in FIGS. 1 and 2, the slides are in the closed position or with the drawer inside the cabinet. If the drawer is pulled out (moved right, as viewed in FIGS. 1 and 2), the outer race 7 moves with the drawer.

The cable drive 6 causes the gussets 4 and 5 and the inner race 10 of the frame slide and the inner race 16 of the drawer slide to move in unison in the same direction as the drawer but at a lower velocity. Typically, the velocity of the gussets, etc. is one half that of the drawer race 7. The reverse action takes place when the drawer is pushed in. The foregoing is established by the cable drive which will now be explained.

The sheaves 34 and 35 mount a flexible cable 40 formed into a single continuous loop. The axes of the sheaves 34 and 35 are respectively coplanar with the bridges 25 and 26 so that part of each sheave is above the bridges and part below the bridges. Thus as the cable is mounted on the sheave, the top part 41 of the loop runs on top of the bridges adjacent the drawer slide 2 while the bottom part 42 runs underneath the bridges adjacent the frame slide 3.

The top part 41 of the loop is joined to the drawer slide 2 as by the coupler 43. The bottom part 42 of the loop is joined to the frame slide 2 as by the coupler 44.

Figure 5:
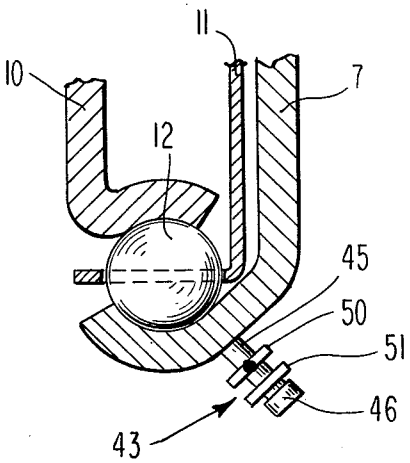
FIG. 5 is a large fragmentary view taken at 5—5 of FIG. 3.

Referring to FIG. 5, the coupler 43 includes a pin 45 which is projection welded to the outer race 7. The pin has an enlarged head 46. The coupler 44 has a similar pin 47 (FIG. 4) on the outer race 15.

Figure 6:
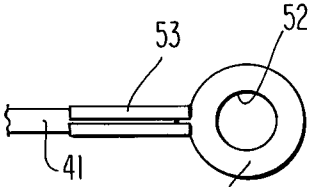
FIG. 6 is a plan view of an eye-type connector.

As best indicated in FIG. 2, the top part 41 of the loop is split. The respective ends are permanently fixed to the eye-type connectors 50 and 51 which form part of the coupler. As noted for the connector 50 in FIG. 6, the same has an open eye 52 and a crimping section 53 which is crimped down on the cable to bind the connector and the cable together. The eye is of a larger diameter than the head 46 so that the connector can be slipped over the head onto the pin 45.

The bottom part 42 of the loop is similarly split. The free ends are permanently fixed to the connectors 54 and 55 of coupler 44. These connectors are identical to connectors 50 and 51. The connectors 54 and 55 are disposed on the pin 47 of the coupler 44.

The cable drive establishes a driving connection so that with the frame slide race 15 held fixed, outward movement of the drawer to the right as viewed in FIG. 1 causes motion of the outer slide 7 in the same direction. The pin 45 pulls on the connector 51 and the cable running around sheave 35. Since the pin 47 on the race 15 is fixed, the cable moves around the sheave 35 (the sheave rotates to accomodate the motion) and pulls the sheave to the right. This causes the gusset 5, inner races 10 and 16 and gusset 4 to move right. The motion of the sheave 34 to the right causes the section of cable to the pin 47 to play out and compensate for the motion. Where the drawer is pushed in or to the left as viewed in FIG. 1 the reverse action takes place with the pin 45 pulling on connector 51 and the cable to cause sheave 35, gusset 4, etc. to move left.

It is preferable that the sheaves 34 and 35 be of the rotating type in order to minimize friction load on the moving cable. However, it will be understood that a non-rotary sheave may be employed when the sheave material, the cable material and sheave radius cooperate to create a tolerable friction load.

The nature of the drive cable 40 is of significant practical importance. The material must have a long-life characteristic. For example, a normal requirement is that the cable show no visible signs of wear nor exhibit fatigue with 75,000 open-close cycles of a slide assembly. The flexible characteristic must allow the cable to traverse around the sharp bend created by a small diameter sheave without developing a high friction load. Moreover, the cable must be capable of slight yielding in a direction along its axis to adapt the same for use with the pin-eye type connector arrangement as will be explained below.

A cable which I have found to be ideally suitable is a 72 lb. braided Dacron line manufactured by Berkley & Co., Highways 9 and 71 Spirit Lake, Iowa 51360.

The pin-eye type coupler and yieldable cable arrangement is an important feature both from the standpoint savings is assembly time but also in causing the cable to be taut on the sheaves. Tautness is necessary to avoid sloppy operation due to lost motion and to insure that the motion of the right and left hand slides are in synchronization.

In making the continuous loop, the sub-assembly including the connector 51, the top part 41 and connector 55 is first installed. The connector 55 is slipped over the pin 47 and the cable passed over the sheave 35 and the connector 51 then brought up to the pin 45. The length of the cable 41 between the connectors 51 and 55 is chosen so that the connector 51 can only be slipped over the pin 45 by exerting an axial force on the cable to stretch the same until the eye and pin are in alignment. Then the connector 51 is slipped over the pin 45 and released. This operation causes the cable to be taut in position.

The other sub-assembly comprising the loop section 42 with connectors 50 and 54 is then installed in the same manner.

From an inspection of FIG. 5, it will be apparent that the head 46 prevents the connectors 51 and 52 (pulled against the pin by the cable) from slipping off the pin.

Figure 4:
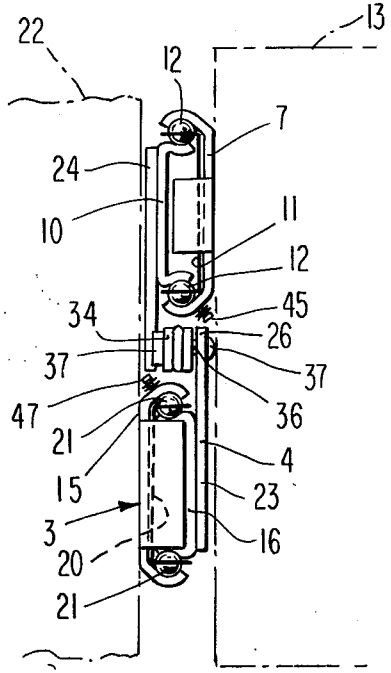
FIG. 4 is an end view taken at 4—4 of FIG. 3.

One feature of the invention which results in lower assembly costs is the orientation of the pins 45 and 47. With reference to FIGS. 4 and 5, it will be seen that the pins are oriented at an angle with respect to the slides 2 and 3. The orientation and the pin length is such that the pins clear the ears and the sheave when the slides 2 and 3 are relatively moved. Thus, the sheave 34 and 35 can be assembled to the gussets and the pins 45 and 47 welded to the races prior to the time that the slides and gussets are assembled together.

Figures 7, 8:
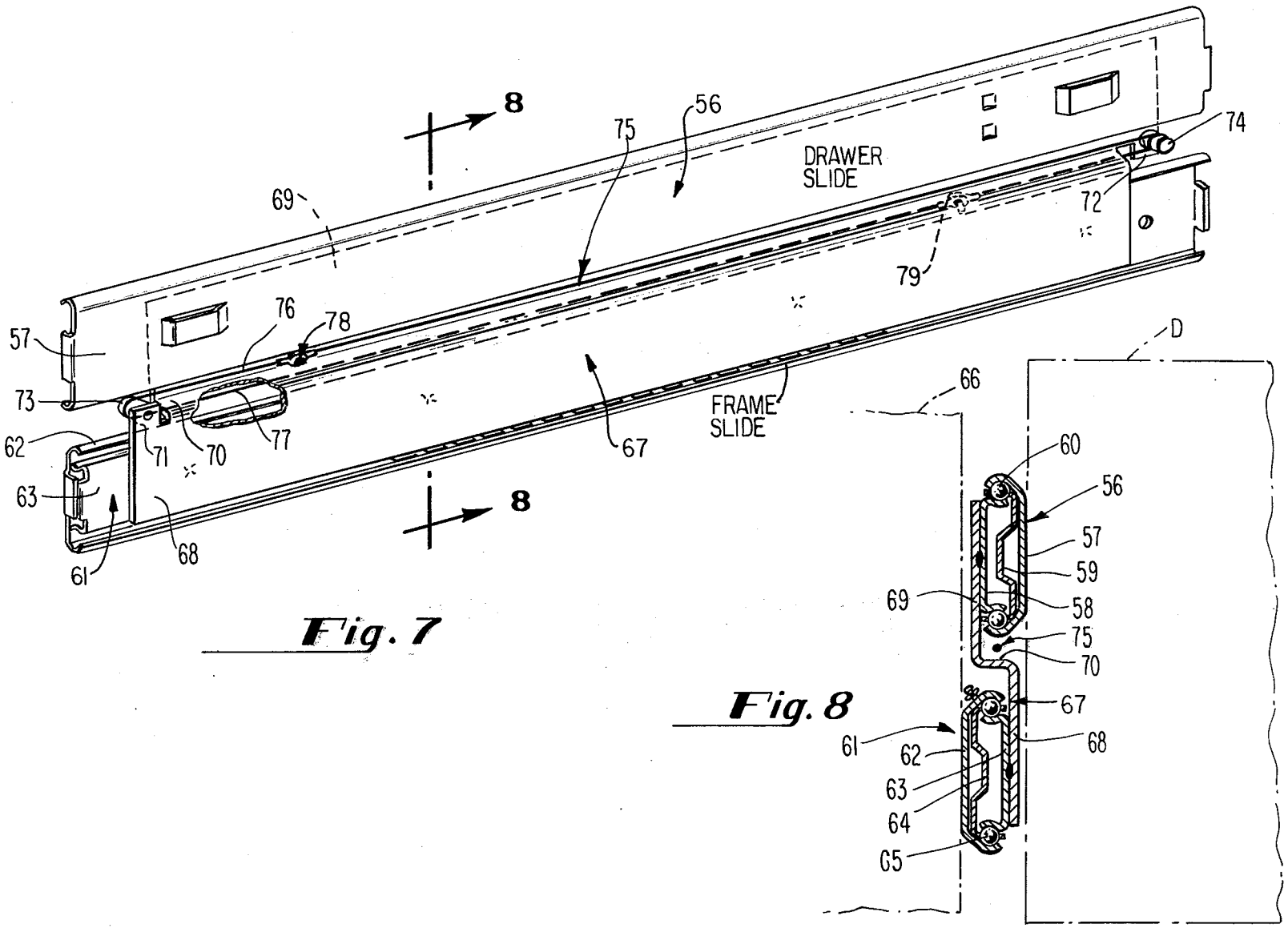
FIG. 7 is a perspective view of a slide assembly constructed in accordance with the invention and employing a single gusset and single loop drive cable.
FIG. 8 is a sectional view taken along the line 7—7 of FIG. 7.

The single loop cable drive finds equal utility in slide assembly employing a single gusset. Such an arrangement is shown in FIGS. 7 and 8.

The drawer slide is indicated in 56 and this comprises the outer race 57, the inner race 58, beating retainer 59 and ball bearings 60. The slide 56 is connected to the drawer D. The frame slide 61 has outer race 62, inner race 63, retainer 64 and ball bearings 65. The slide 61 is connected to the frame 66.

The gusset 67 is substantially coextensive with the slides 57. The gusset has a lower section 68, an upper section 69 and a bridge 70. The cross-section of the gusset is the same as the cross-section of the gussets 4 and 5. The lower section 68 is connected to the inner race 63 while the upper section 69 is connected to the inner race 58.

The gusset has ears 71 and 72 which respectively support the sheaves 73 and 74 mounting the cable 75.

The cable 75 is formed into a continuous loop similarly as the cable 40. The sheaves 73 and 74 mount the cable so that the upper part 76 runs over the bridge adjacent the drawer slide while the lower part 77 runs on the bottom side of the bridge adacent the frame slide.

The coupler 78 joins the loop section 76 to the drawer slide while the coupler 79 joins the loop section 77 to the frame slide. The couplers 78 and 79 have the same structure as the connectors explained in connection with FIG. 1.

It will be understood that the cable 75 establishes the same kind of driving connection for the inner and outer races of the slides 56 and 61 and gusset 67 as expressed in the description of the cable drive of FIGS. 1 thru 6.

I claim:

1. In a progessive slide:

an elongated drawer slide having a pair of races and ball bearings therebetween;

an elongated frame having a pair of races and ball bearings therebetween, the frame slide extending parallel to and substantially coextensive with the drawer slide;

gusset means connecting one of the races of the drawer slide and one of the races of the frame slide;

sheave means interconnected to the gusset means;

coupler means mounted on the other race of said drawer slide;

coupler means mounted on the other race of said frame slide; and flexible cable means mounted on said sheave means, the cable being made of material providing for the cable to be stretchable in a direction along its axis; and each said coupler means having mechanism to receive the cable means in stretched condition as between the sheaves and the coupler means and to hold the cable in such condition, the stretched condition providing for the cable to be taut and the cable establishing a driving connection whereby when the other race of said frame slide is held fixed and the other race of said drawer slide is moved, said gusset means, said one rail of the drawer slide and said one rail of the frame slide move in unison in the same direction but at a lower velocity.

2. In a progessive slide:

an elongated drawer slide having a pair of races and ball bearings therebetween;

an elongated frame slide having a pair of races and ball bearings therebetween, the frame slide extending parallel to and substantially coextensive with the drawer slide;

gusset means connecting one of the races of the drawer slide and one of the races of the frame slide;

sheave means interconnected to the gusset means;

flexible cable means mounted on said sheave means, the cable being made of a material whereby the cable is stretchable in a direction along its axis;

coupler means on the other race of said drawer slide comprising a pin on the other race, a pair of eye-type connectors disposed over the pin and respectively fixed to said cable means and means on the pin for maintaining the connectors thereon; and coupler means on the other race of said frame slide comprising a pin on the other frame slide race, a pair of eye-type connectors disposed over last said pin and respectively fixed to said cable means and means on last said pin for maintaining the connectors thereon, the cable means being in a stretched condition as between the sheave means and the couplers, the stretched condition providing for the cable to be taut and the cable establishing a driving connection whereby when the other race of said frame slide is held fixed and the other race of said drawer slide is moved, said gusset means, said one rail of the drawer slide and said one rail of the frame slide move in unison in the same direction but at a lower velocity.

3. In a progressive slide:

an elongated drawer slide having a pair of races and ball bearings therebetween;

an elongated frame slide having a pair of races and ball bearings therebetween, the frame slide extending parallel to and substantially coextensive with the drawer slide;

a first gusset connecting one of the races of the drawer slide and one of the races of the frame slide and disposed adjacent one end of the slides, the first gusset having a first bridge section disposed in the space between the drawer slide and the frame slide;

a second gusset connecting said one race of the drawer slide and said one race of the frame slide and disposed adjacent the opposite end of the slides whereby to be spaced from and independent of said first gusset and the second gusset having a second bridge section disposed in the spaced between the drawer slide and the frame slide;

a first sheave connected to the first gusset;

a second sheave connected to the second gusset;

flexible cable means formed into a continuous loop and mounted on said sheaves, the sheaves positioning the cable means so that one part of the loop extends along adacent said drawer slide and the other part of the loop extends along adjacent said frame slide; and the flexible cable means being made of material providing for the cable to be stretchable in a direction along its axis;

coupler means on the other race of said drawer slide and fixed to said cable; and coupler means on the other race of said frame slide and fixed to said cable, the cable means being in a stretched condition as between the sheave means and the couplers, the stretched condition providing for the cable to be taut and the cable establishing a driving connection whereby when the other race of said frame slide is held fixed and the other race of said drawer slide is moved, said gussets, said one rail of the drawer slide and said one rail of the frame slide move in unison in the same direction but at a lower velocity.

4. The progressive slide of claim 3, wherein each said coupler means includes a pin on the respective other race, a pair of eye-type connectors disposed over the pin and respectively fixed to said cable means and means on the pin for maintaining the connectors thereon.

5. In a progressive slide:

an elongated drawer slide having a pair of races and ball bearings therebetween;

an elongated frame slide having a pair of races and ball bearings therebetween the frame slide being disposed below and extending parallel to and substantially coextensive with the drawer slide;

a first gusset connecting one of the races of the drawer slide and one of the races of the frame slide and disposed adjacent one end of the slides, the first gusset having a first bridge section disposed in the spaced between the drawer slide and the frame slide;

a second gusset connecting said one race of the drawer slide and said one race of the frame slide and disposed adjacent the opposite end of the slides whereby to be spaced from and independent of said first gusset and the second gusset having a second bridge section disposed in the space between the drawer slide and the frame slide;

a first sheave connected to the first gusset;

a second sheave connected to the second gusset;

a drawer slide pin on the other race of said drawer slide and extending into the space between the slides;

a frame slide pin on the other race of said frame slide and extending into the space between the slides;

a first length of flexible cable mounted on said first sheave, the first sheave supporting the first length so that part of the same extends along adjacent said drawer slide and part extends along adjacent the frame slide and the first length having a pair of eye-type fasteners respectively fixed on opposite ends, one fastener being disposed over said drawer slide pin and the other fastener being disposed over said frame slide pin:

a second length of flexible cable mounted on said second sheave, the second sheave supporting the second length so that part of the same extends along adjacent said drawer slide and part extends along adjacent said frame slide and the second length having a pair of eye-type fasteners respectively fixed on opposite ends, one fastener disposed over said drawer slide pin and the other fastener being disposed over said frame slide pin;

means respectively on said pins for maintaining the connectors thereon; and each said length of cable being made of material providing for the length to be stretchable in a direction along its axis and said lengths and fasteners forming a continuous loop and said cable lengths each being in stretched condition as between the sheaves and pins, the stretched condition providing for the loop of cable to be taut and the loop establishing a driving connection whereby when the other race of said frame slide is held fixed and the other race of said drawer slide is moved, said gussets, said one rail of the drawer slide and said one rail of the frame slide move in unison in the same direction but at a lower velocity.

6. In a progressive slide:

an elongated drawer slide having a pair of races and ball bearings therebetween;

an elongated frame slide having a pair of races and ball bearings therebetween, the frame slide extending parallel to and substantially coextensive with the drawer slide;

a gusset connecting one of the races of the drawer slide and one of the races of the frame slide, the gusset having a bridge section disposed in the space between the drawer slide and the frame slide;

a first sheave connected adjacent one end of the gusset;

a second sheave connected adjacent the other end of the gusset;

flexible cable means formed into a continuous loop and mounted on said sheaves, the sheaves positioning the cable means so that one part of the loop extends along adjacent said drawer slide and the other part of the loop extends along adjacent said frame slide; and the cable means being made of material providing for the cable to be stretchable in a direction along its axis;

coupler means on the other race of said drawer slide and fixed to said cable; and coupler means on the other race of said frame slide and fixed to said cable; each said coupler means having mechanism to receive the cable means in stretched condition as between the sheaves and the coupler means and to hold the cable in such condition the stretched condition providing for the cable to be taut and the cable establishing a driving connection whereby when the other race of said frame slide is held fixed and the other race of said drawer slide is moved, said gusset, said one rail of the drawer slide and said one rail of the frame slide move in unison in the same direction but at a lower velocity.

7. In a progressive slide:

an elongated drawer slide having a pair of races and ball bearings therebetween;

an elongated frame slide having a pair of races and ball bearings therebetween, the frame slide extending parallel to and substantially coextensive with the drawer slide;

a gusset connecting one of the races of the drawer slide and one of the races of the frame slide, the gusset having a bridge section disposed in the space between the drawer slide and the frame slide;

a first sheave connected adjacent one end of the gusset;

a second sheave connected adjacent the other end of the gusset;

a drawer slide pin on the other race of said drawer slide and extending into the space between the slides.

a frame slide pin on the other race of said frame slide and extending into the space between the slides;

a first length of flexible cable mounted on said first sheave, the first sheave supporting the first length so that part of the same extends along adjacent said drawer slide and part extends along adjacent the frame slide and the first length having a pair of eye-type fasteners respectively fixed on opposite ends, one fastener disposed over said drawer slide pin and the other fastener being disposed over said frame slide pin;

a second length of flexible cable mounted on said second sheave, the second sheave supporting the second length so that part of the same extends along adjacent said drawer slide and part extends along adjacent said frame slide and the second length having a pair of eye-type fasteners respectively fixed on opposite ends, one fastener disposed over said drawer slide pin and the other fastener being disposed over said frame slide pin, said cable lengths and said fasteners forming a continuous loop and said cable lengths each being made of material providing for the length to be stretchable in a direction along its axis and the lengths being in stretched condition as between the sheaves and pins, the stretched condition providing for the loop of cable to be taut and the loop establishing a driving connection whereby when the other race of said frame slide is held fixed and the other race of said drawer slide is moved, said gusset, said one rail of the drawer slide and said one rail of the frame slide move in unison in the same direction but at a lower velocity; and means respectively on said pins for maintaining the connectors thereon.

8. In a progressive slide;

an elongated drawer slide having a pair of races and ball bearings therebetween;

an elongated frame slide having a pair of races and ball bearings therebetween, the frame slide extending parllel to and substantially coextensive with the drawer slide;

a first gusset connecting one of the races of the drawer slide and one of the races of the frame slide, the guesset being disposed adjacent one end of the slides;

a second gusset conneting said one race of the drawer slide and said one race of the frame slide, the second gusset being disposed adjacent the opposite end of the slides whereby to be spaced from and independent of said first gusset;

sheave means interconnected to said gussets;

coupler means mounted on the other race of said drawer slide;

coupler means mounted on the other race of said frame slide;

flexible cable means mounted on said sheave means and fastened to said coupler means so as to be taut as between the sheave means and the coupler means and the cable establishing a driving connection whereby when the other race of said frame slide is held fixed and the other race of said drawer slide is moved, said gussets, said one rail of the drawer slide and said one rail of the frame slide move in unison in the same direction but at a lower velocity; and said flexible cable means being made of material providing for the cable to be stretchable in a direction along its axis and each of said coupler means including a pin on the respective other races, a pair of eye-type connectors disposed over the pin and respectively fixed to said cable means and means on the pin of maintaining the connectors thereon and said cable means being in stretched condition as between said sheave means and coupler means, the stretched condition providing for said tautness.

9. In a progressive slide:

an elongated drawer slide having a pair of races and ball bearings therebetween;

an elongated frame slide having a pair of races and ball bearings therebetween the frame slide extending parallel to and substantially coextensive with the drawer slide;

a first gusset connecting one of the races of the drawer slide and one of the races of the frame slide, the gusset being disposed adjacent one end of the slides;

a second gusset connecting said one race of the drawer slide and said one race of the frame slide, the second gusset being disposed adjacent the opposite end of said slides whereby to be spaced from and independent of said first gusset;

first sheave means mounted adjacent one end of said first gusset;

second sheave means mounted adjacent one end of said second gusset;

coupler means mounted on the other race of said drawer slide;

coupler means mounted on the other race of said frame slide;

flexible cable means formed into a continuous loop and mounted on said sheaves and fixed to said coupler means so as to be taut as between the sheave means and the coupler means and the cable establishing a driving connection whereby when the other race of said frame slide is held fixed and the other race of said drawer slide is moved, said gussets, said one rail of the drawer slide and said one rail of the frame slide move in unison in the same direction but at a lower velocity, and said flexible cable means being made of material providing for the cable to be stretchable in a direction along its axis and each of said coupler means including a pin on the respective other races, a pair of eye-type connectors disposed over the pin and respectively fixed to said cable means and means on the pin for maintaining the connectors thereon and said cable means being in stretched condition as between said sheave means and coupler means, the stretched condition providing for said tautness.

* * * * *